8-107 SR
FIP8309 XR 4,378,967

United States Patent [19]
Yotsuya et al.
[11] 4,378,967
[45] Apr. 5, 1983

[54] PROCESS FOR BLEACHING FIBROUS MATERIAL BY HYDROGEN PEROXIDE

[75] Inventors: Minoru Yotsuya, Toride; Kiyoshi Mae, Toyonaka; Seikyu Jinnouchi; Toshio Ochiai, both of Matsudo, all of Japan

[73] Assignee: Mitsubishi Gas Chemical Co., Inc., Tokyo, Japan

[21] Appl. No.: 306,925

[22] Filed: Sep. 29, 1981

Related U.S. Application Data

[63] Continuation of Ser. No. 114,255, Jan. 22, 1980, abandoned.

[30] Foreign Application Priority Data

Jan. 26, 1979 [JP] Japan ..... 54-8068

[51] Int. Cl.[3] ..... D06L 3/04; D06L 3/14
[52] U.S. Cl. ..... 8/111; 8/107
[58] Field of Search ..... 8/111; 162/78

[56] References Cited

U.S. PATENT DOCUMENTS

| | | | |
|---|---|---|---|
| 2,057,296 | 10/1936 | Fabian et al. | 8/111 |
| 2,194,358 | 3/1940 | Hundt et al. | 8/111 |
| 2,283,141 | 5/1942 | Kauffman et al. | 8/111 |
| 2,875,018 | 2/1959 | Easton et al. | 8/111 |
| 3,251,731 | 5/1966 | Gard | 8/111 |
| 3,811,833 | 5/1974 | Statler | 8/111 |
| 4,060,385 | 11/1977 | Katz | 8/111 |

*Primary Examiner*—Maria Parrish Tungol
*Attorney, Agent, or Firm*—Armstrong, Nikaido, Marmelstein & Kubovcik

[57] ABSTRACT

A fibrous material is bleached by hydrogen peroxide in a weakly acidic state at a pH of 5–7, and then in a weakly alkaline state at a pH of 8.5–1.1 by adding an alkaline agent to the hydrogen peroxide by one whole charge or continuously after the bleaching in the weakly acidic state and utilizing the remaining hydrogen peroxide. The bleached fibrous material has a soft handling and a high whiteness, and no bleaching unevenness.

14 Claims, No Drawings

PROCESS FOR BLEACHING FIBROUS MATERIAL BY HYDROGEN PEROXIDE

This is a continuation of application Ser. No. 114,255, filed Jan. 22, 1980 now abandoned This invention relates to a process for bleaching a fibrous material by hydrogen peroxide, thereby obtaining a bleached fibrous material with a soft handling and a high whiteness, and more particularly to a process for bleaching with generation of less including bleaching by means of a natural circulation type bleaching apparatus, for example, the so-called kier, NK bleacher, etc.

Generally, it has been regarded as essential to carry out bleaching by hydrogen peroxide in an alkaline state; the bleaching of cotton, etc. is carried out at a considerably high pH value, such as 11–12, but the bleaching by hydrogen peroxide in an alkaline state has the following great disadvantages, which depend upon the properties of fibrous materials, etc.

(1) Bleaching is immediately carried out in a high pH range, and consequently bleached cotton fibers, etc. have a hard handling. Thus, it is not preferable for the bleaching of cotton knit underwear, etc.

(2) Bleaching of cotton knit underwear, etc. is carried out in most cases by means of a natural circulation type bleaching apparatus called "kier" on account of the properties of the products. In that case, one-bath bleaching by hydrogen peroxide in the alkaline state often makes the bleaching uneven.

(3) One-bath bleaching by hydrogen peroxide in the alkaline state produces a large amount of polluting materials, and consequently an expensive waste water treatment is required.

Thus, in the case of cotton yarns, etc., where a hard handling is not objectionable, one-bath bleaching by hydrogen peroxide in a forced circulation type bleaching apparatus generally called "cheese", "beam", and "overmaier" is employed; but in the case of cotton knit underwear, and sun-bleached pieces, the one-bath bleaching by hydrogen peroxide in the alkaline state cannot be carried out on account of the above-mentioned disadvantages, and bleaching based principally on a chlorine bleacher, for example, sodium chlorite, sodium hypochlorite, etc. must be employed.

The cotton knit underwear, etc. require soft handling with less wrinkles, and thus two-stage bleaching of sodium chlorite bleaching-dechlorinating or anti-chlorinating additional bleaching by hydrogen peroxide in a weakly alkaline state by means of a kier is usually employed, where bleached products with a soft handling and no bleaching unevenness can be obtained.

On the other hand, in the sun-bleached pieces of cotton gauze, cotton cloth, etc., multi-stage bleaching of caustic soda scouring-caustic soda scouring-sodium hypochlorite bleaching-dechlorinating or anti-chlorinating additional bleaching by hydrogen peroxide in a weakly alkaline state by means of a NK bleacher is usually employed, where bleached products with no bleaching unevenness can be obtained.

However, these bleaching processes require complicated and much time-consuming bleaching operations such as washing, refilling, etc. of materials to be bleached between the stages. Furthermore, use of the chlorine bleacher has a problem of disagreeable smell generation and is not preferable from the viewpoint of environmental safety and also a waste water treatment.

The present inventors have made extensive studies of bleaching only by hydrogen peroxide as a bleacher to obtain bleached products having a soft handling, a high whiteness and no bleaching unevenness.

It has been regarded as essential that the bleaching by hydrogen peroxide is generally carried out in a higher pH range, that is, at a higher alkaline side, such as a pH of 11–12, on account of the properties of hydrogen peroxide. The reasons are as follows according to the literatures, references, etc. Hydrogen peroxide reacts with $OH^-$ in an alkaline state to produce $HO_2^-$ ($H_2O_2 + OH^- \rightarrow HO_2^- + H_2O$), and the $HO_2^-$ thus produced takes part in bleaching. Maximum bleaching intensity can be obtained, in the case of cotton fibers, etc. at a pH of 11–12. On the other hand, in an acidic pH range, less $HO_2^-$ is produced, and consequently the bleaching intensity is poor.

As a result of studies of bleaching characteristics of hydrogen peroxide in the entire pH range, the present inventors have found that hydrogen peroxide has a considerably high bleaching intensity even in a weakly acidic pH range, such as a pH of 5–7.

In a range of a practically applicable amount of hydrogen peroxide, the bleaching by hydrogen peroxide in said weakly acidic state can give a whiteness substantially equal to that obtained by bleaching by single sodium chlorite, though it is not equal to the whiteness obtained by one-bath bleaching by hydrogen peroxide in an alkaline state at a pH of 11–12. The resulting bleached products have a very good touch, a good water absorbability, no substantial deterioration in strength, and much less generation of polluting materials. Furthermore, the bleaching can be carried out in a natural circulation-type bleaching apparatus without any bleaching unevenness. In contrast with the one-bath bleaching by hydrogen peroxide in an alkaline state at a pH of 11–12, it has been found that the bleaching by hydrogen peroxide in a weakly acidic state at a pH of 5–7 has less consumption of hydrogen peroxide due to the decomposition, and 70 to 80% by hydrogen peroxide can remain on the basis of the amount of hydrogen peroxide charged.

However, the whiteness is not so good in the single bleaching by hydrogen peroxide in a weakly acidic state at a pH of 5–7 as in the conventional bleaching process of bleaching by sodium chlorite-dechlorinating or anti-chlorinating additional bleaching by hydrogen peroxide in a weakly alkaline state, etc., and thus is not practical. The present inventors have further found that the whiteness can be considerably increased by adding an alkaline agent to the hydrogen peroxide after the bleaching by hydrogen peroxide in a weakly acidic state, thereby making a pH of 8.5–11, and conducting bleaching by hydrogen peroxide in a weakly alkaline state while utilizing the remaining hydrogen peroxide, and that a whiteness equal or superior to that obtained by the conventional bleaching process of bleaching by sodium chlorite-dechlorinating or anti-chlorinating additional bleaching by hydrogen peroxide in a weakly alkaline state or bleaching by hydrogen peroxide in an alkaline state at a pH of 11–12 can be obtained thereby.

The present invention provides a process for bleaching a fibrous material by hydrogen peroxide, which comprises bleaching a fibrous material by hydrogen peroxide in a weakly acidic state at a pH of 5–7, and then adding an alkali agent to a bleaching system by one whole charge or continuously, and successively bleaching the fibrous material at a pH of 8.5–11 by remaining hydrogen peroxide in a weakly alkaline state.

The fibrous material to be bleached according to the present invention includes natural, synthetic or semi-synthetic fibers, or mix-spun, mix-woven, mix-knitted products or fabrics of these fibers, or other fiber products.

The bleaching by hydrogen peroxide is a weakly acidic state according to the present invention is carried out at a pH of 5–7, as described above. The adjustment of pH by an acid or alkali is not especially required when a neutral surfactant is used, for example, as a bleaching auxiliary (the surfactant usually used in bleaching of fibers is of neutral type almost in all the cases), and the pH can be maintained substantially in a pH range of 5–7 by mixing water, hydrogen peroxide and a surfactant. When especially required, the pH may be adjusted to 5–7 by means of the ordinary acid or alkali.

The hydrogen peroxide can be used in such an amount as used in the ordinary bleaching, and thus the amount of hydrogen peroxide is not particularly restricted. A practically approximate amount of hydrogen peroxide is 2–100 cc/l, preferably 5–30 cc/l of 35% by weight hydrogen peroxide.

The bleaching in a weakly alkaline state according to the present invention is carried out at a pH of 8.5–11 by adding an alkaline agent to the bleaching system after said bleaching in the weakly acidic state.

The alkaline agent to be added can be the ordinary alkaline agent as used in the bleaching, and includes alkali metal phosphates such as sodium tertiary phosphate, sodium pyrophosphate, etc.; weakly acidic salts of alkali metal such as sodium metaborate, sodium carbonate, sodium silicate, etc.; alkali metal hydroxides such as caustic soda, caustic alkali, etc.; ammonia water; alkaline ammonium salts such as ammonium carbonate, etc., and mixtures of at least two of these compounds. The amount of the alkaline agent to be added is such as to make a pH of 8.5–11. The alkaline agent can be added to the bleaching system in any manner, for example, by one whole charge, or by continuous charge. However, the continuous charge is sometimes more effective upon the attained whiteness and handling than the one whole charge. Preferable time for the continuous charge is usually 20–40 minutes.

Temperature and time for the bleachings in the weakly acidic state and the weakly alkaline state can be in the ordinary ranges, and are not particularly restricted, but usually the suitable temperature and time are 50°–120° C., and 0.5–5 hours, respectively, and are selected in view of the kind and shape of fibrous material to be bleached, kind of bleaching apparatus, requirements for desired products, and states of products.

When the bleaching in the weakly alkaline stage according to the present invention is carried out at a high temperature side the handling of the bleached product inevitably becomes hard to some degree. When a soft handling is mainly required for a bleached product, the bleaching in the weakly alkaline state must be carried out at a low temperature side. When a high whiteness is required at the expense of the soft handling to some extent on the other hand, the bleaching in the weakly alkaline state must be carried out at a high temperature side.

According to the present invention, the bleaching by hydrogen peroxide in the weakly alkaline state can be also carried out after water washing and dehydration separately from the bleaching by hydrogen peroxide in the weakly acidic state.

According to the present invention, if the amount of the remaining hydrogen peroxide is small after the bleaching by hydrogen peroxide in the weakly acidic state, hydrogen peroxide can be supplemented at the same time when the alkaline agent is added to obtain a high whiteness, and then the bleaching by hydrogen peroxide in the weakly alkaline state can be carried out.

According to the present invention, any bleaching apparatus as used in the ordinary bleaching, for example, a natural circulation type apparatus, a forced circulation type apparatus, etc. can be used, so long as it is free from corrosion by hydrogen peroxide.

In order to improve the permeation of the chemical into the fibrous material, a surfactant as used in the ordinary bleaching of fibers is used. The surfactant can be used according to the applicable amount of commercially available ones, though the amount depends upon the purity and permeation power of the commercially available surfactant, and the appropriate amount of the surfactant is generally 0.1–2 g/l as a 100% pure surfactant.

In contrast with the conventional bleaching processes; for example, two-stage bleaching of cotton knit underwear by means of the natural circulation type, bleaching apparatus, (bleaching by sodium chlorite in an apparatus made from titanium-water washing and dehydration-refilling of the bleached fibrous material-dechlorinating or antichlorinating additional bleaching by hydrogen peroxide in a weakly alkaline state in an apparatus made from stainless steel), or multi-stage bleaching by means of a natural circulation-type bleaching apparatus such as sun-bleached pieces, etc. (caustic soda scouring-water washing and dehydration-refilling of the bleached fibrous material-second caustic soda scouring-water washing and dehydration-refilling of the bleached fibrous material-bleaching by sodium hypochlorite-water washing and dehydration-refilling of the bleached fibrous-dechlorinating or antichlorinating additional bleaching by hydrogen peroxide in a weakly alkaline state), etc.; the present invention is very simple in steps and requires only one bleaching apparatus without a wide space, and the apparatus cost, steam cost, water cost and man power cost are very low. Furthermore, no disagreeable smell of chlorine group is generated, and a very good working state can be also attained in environmental safety.

When bleaching according to the present invention is carried out by means of a forced circulation-type bleaching apparatus, no bleaching unevenness is produced, where the one-bath bleaching by hydrogen peroxide in an alkaline state at a pH of 11–12 is now carried out, for example, cheese, beam, overmair, etc., or by means of a wince, paddle washer, injection-type beaching apparatus, etc., a good handling can be obtained with no generation of polluting materials.

The present invention is also effective upon composite material products now in fashion. For example, mix spun products, etc. of cotton, to which the bleaching by hydrogen peroxide in an alkaline state at a pH of 11–12 is essential, with wool to which a chlorine bleacher is not applicable, but only bleaching by hydrogen peroxide in a weakly alkaline state at a pH of 8.5–9.3 at a low temperature is applicable, can be effectively bleached according to the present invention.

As described above, bleaching with a soft handling, a high whiteness, no generation of bleaching unevenness, and less generation of polluting materials can be attained according to the present invention; and steps, time, utility cost, environmental conditions, and quality of bleached products can be remarkably improved, as compared with the conventional bleaching processes.

The present invention will be described in detail below, referring to Examples and Comparative Examples, where whiteness, handling, strength and amount of polluting materials generated are determined according to the following procedures:

(1) Whiteness

Whiteness is determined according to an L-a-b system using a color studio made by Nippon Denshoku Kogyo K. K., Japan, where L, a and b have the following meanings.

L: Lightness; a: (+) reddish, (−) greenish,
b: (+) yellowish, (−) bluish

Among them, the value b is in a good accordance with a visibility, and thus the whiteness is determined by the value b. The smaller the value b, the more reduced the yellowishness, that is, the higher the whiteness. The bleaching unevenness is determined by a fluctuation amplitude of the value b by measuring the value b at 20 different locations on a bleached sample. The fluctuation amplitude of the value b of not more than 0.4 is judged to be "no bleaching unevenness", whereas that of more than 0.4 is judged to be a significant bleaching unevenness.

(2) Handling

The soft handling state of raw cotton is presumed to be grade 1, whereas the hard handling state obtained by one-bath bleaching by hydrogen peroxide in an alkaline state at a pH of 11–12 to be grade 10, giving 10 grades from grade 1 to grade 10 according to the touch and feeling with naked fingers.

(3) Strength

Tensile strength is measured by Tensilon (trademark) made by Toyo Bauldwin K. K., Japan, and the strength of raw sample is presumed to be 100%, and the strength is judged by percent strength retainability.

(4) Amount of polluting materials generated

TOC (Total Organic Carbon) of bleaching solution after the end of bleaching is measured according to TOC analyzer made by Shimazu Seisakusho, Ltd., Japan, and the amount of polluting material generated is judged by the amount of TOC generated.

EXAMPLE 1 AND COMPARATIVE EXAMPLES 1–3

Bleaching of cotton knit underwears requiring a soft handling, a high whiteness without any bleaching unevenness was carried out in a natural circulation type bleaching apparatus and a forced circulation type bleaching apparatus. The results are shown in Table 1.

(1) EXAMPLE 1

Bleaching by hydrogen peroxide in a weakly acidic state and then bleaching by hydrogen peroxide in a weakly alkaline state were carried out in a natural circulation type bleaching apparatus under the following conditions:

Bleaching by hydrogen peroxide in the weakly acidic state:

| | | |
|---|---|---|
| Chemicals added: | 35% $H_2O_2$ | 20 cc/l |
| | Sandozine NIT (trademark of neutral surfactant, made by Sandoz Products, Ltd.) | 1 g/l |
| pH: | 6.0 | |
| Bath ratio: | 1:8 | |
| Temperature: | 90° C. | |
| Time: | 90 minutes | |

Bleaching by hydrogen peroxide in the weakly alkaline state:

| | | |
|---|---|---|
| Chemicals added: | Sodium silicate No. 3 | 2 g/l |
| | $Na_2CO_3$ | 6 g/l |
| pH: | 10.1 | |
| Temperature: | 90° C. | |
| Time: | 60 minutes | |

(2) COMPARATIVE EXAMPLE 1

Conventional bleaching by sodium chlorite was carried out in a natural circulation-type, bleaching apparatus.

Bleaching by sodum chlorite in a bleaching apparatus made from titanium:

| | | |
|---|---|---|
| Chemicals added: | 25% $NaClO_2$ | 10 cc/l |
| | Sandozine NIT | 1 g/l |
| | Anti-smell agent Z-50 (made by Daito Yakuhin K.K. Japan) | 1 g/l |
| pH: | 3.5 (pH adjusted by acetic acid) | |
| Bath ratio: | 1:8 | |
| Temperature: | 90° C. | |
| Time: | 90 minutes | |

↓

Water washing and dehydration

↓

Refilling into a bleaching apparatus made from stainless steel

↓

Dechlorinating or antichlorinating additional bleaching by hydrogen peroxide in a weakly alkaline state

| | | |
|---|---|---|
| Chemicals added: | 35% $H_2O_2$ | 5 cc/l |
| | Sandozine NIT | 0.5 g/l |
| | Sodium silicate No. 3 | 2 g/l |
| pH: | 10.2 (pH adjusted by caustic soda) | |
| Bath ratio: | 1:8 | |
| Temperature: | 90° C. | |
| Time: | 60 minutes | |

(3) COMPARATIVE EXAMPLE 2

One-bath bleaching by hydrogen peroxide in an alkaline state was carried out in a natural circulation-type bleaching apparatus.

| | | |
|---|---|---|
| Chemicals added: | 35% $H_2O_2$ | 20 cc/l |
| | Sandozine NIT | 1 g/l |
| | Sodium silicate No. 3 | 5 g/l |
| pH: | 11.2 (pH adjusted by caustic soda) | |
| Bath ratio: | 1:8 | |
| Temperature: | 90° C. | |
| Time: | 150 minutes | |

(4) COMPARATIVE EXAMPLE 3

One-bath bleaching by hydrogen peroxide in an alkaline state was carried out in a forced circulation type, bleaching apparatus.

| | | |
|---|---|---|
| Chemicals added: | 35% $H_2O_2$ | 5 cc/l |
| | Sandozine NIT | 1 g/l |
| | Sodium silicate No. 3 | 1 g/l |
| pH: | 10.2 and 11.2 (pH adjusted by caustic soda) | |
| Temperature: | 90° C. | |
| Time: | 150 minutes | |

| | | |
|---|---|---|
| Chemicals added: | Sodium silicate No. 3 | 3 g/l |
| | NaOH | 3 g/l |
| pH: | 11.0 | |
| Temperature: | 95° C. | |
| Time: | 60 minutes | |

(2) COMPARATIVE EXAMPLE 4

Bleaching by sodium hypochlorite now widely employed:

First caustic soda scouring

TABLE 1

| | Conditions | Bleaching pH | Remaining $H_2O_2$ | Yellowishness value b: Fluctuation of b | Yellowishness value b: Average b | Bleaching unevenness | Handling | TOC generated | |
|---|---|---|---|---|---|---|---|---|---|
| | Unbleached, raw cotton knit | — | — | 12.2–12.4 | 12.3 | — | 1 | — | |
| (1) Ex. 1 | After bleaching by $H_2O_2$ in weakly acidic state | 6.0 | 82.1% | 3.4–3.6 | 3.5 | None | 2 | 1600 | 2150ppm |
| | After bleaching by $H_2O_2$ in weakly alkaline state | 10.1 | 68.3 | 1.4–1.6 | 1.5 | None | 5 | 550 | |
| (2) Comp. Ex. 1 | After bleaching by sodium chlorite | 3.5 | — | 2.8–3.2 | 3.0 | None | 3 | 1350 | 2150 |
| | After antichlorinating additional bleaching by $H_2O_2$ in weakly alkaline state | 10.2 | 92.0 | 1.7–2.0 | 1.8 | None | 6 | 800 | |
| (3) Comp. Ex. 2 | One-bath bleaching by $H_2O_2$ in alkaline state | 11.2 | 44.9 | 2.2–5.5 | 3.7 | Yes | 10 | 2600 | |
| (4) Comp. Ex. 3 | One-bath bleaching by $H_2O_2$ in alkaline state pH 10.2 | 10.2 | 85.2 | 2.8–3.0 | 2.9 | None | 7 | 2350 | |
| | One-bath bleaching by $H_2O_2$ in alkaline state pH 11.2 | 11.2 | 39.8 | 1.6–1.8 | 1.7 | None | 10 | 2750 | |

Comparative Example 3 is actually not carried out, because small wrinkles appear in the knit underwear, and no commercial product is available, but done only for comparison with the present invention.

As is obvious from Table 1, bleaching with soft handling and high whiteness without any bleaching uneveness can be carried out according to the present invention, which is equal to the bleaching by sodium chlorite now widely employed. In the present invention the amount of TOC generated is small.

EXAMPLE 2 AND COMPARATIVE EXAMPLES 4 AND 5

Bleaching of desired cotton gauze was carried out in a natural circulation-type, bleaching apparatus. In the case of cotton gauze, a soft handling is not so much required, but a high whiteness without any bleaching unevenness is required. Results are shown in Table 2.

(1) EXAMPLE 2

Bleaching by hydrogen peroxide in the weakly acidic state:

| | | |
|---|---|---|
| Chemicals added: | 35% $H_2O_2$ | 30 cc/l |
| | Sandozine NIT | 1 g/l |
| pH: | 6.9 | |
| Bath ratio: | 1:10 | |
| Temperature: | 90° C. | |
| Time: | 90 minutes | |

Bleaching by hydrogen peroxide in the weakly alkaline state:

| | | |
|---|---|---|
| Chemicals added: | NaOH | 10 g/l |
| | Sandozine NIT | 1 g/l |
| Bath ratio: | 1:10 | |
| Temperature: | 95°–100° C. | |
| Time: | 90 minutes | |

↓

Water washing and dehydration

↓

Refilling for preventing scouring unevenness

↓

Second caustic soda scouring

| | | |
|---|---|---|
| Chemicals added: | 100% NaOH | 5 g/l |
| | Sandozine NIT | 1 g/l |
| Bath ratio: | 1:10 | |
| Temperature: | 95°–100° C. | |
| Time: | 90 minutes | |

↓

Water washing and dehydration

↓

Refilling into another apparatus

↓

Bleaching by sodium hypochlorite

| | | |
|---|---|---|
| Chemicals added: | 12% NaClO | 30 cc/l |
| pH: | 10.5 | |
| Bath ratio: | 1:10 | |
| Temperature: | Normal | |
| Time: | 120 minutes | |

↓

Water washing and dehydration

↓

Dechlorinating or antichlorinating additional bleaching by hydrogen peroxide in weakly alkaline state

| | | |
|---|---|---|
| Chemicals added: | 35% $H_2O_2$ | 5 cc/l |
| | Sandozine NIT | 0.5 g/l |
| | Sodium silicate No. 3 | 5 g/l |
| pH | 10.5 (pH adjusted by caustic soda) | |
| Temperature: | 85° C. | |
| Time: | 60 minutes | |

(3) COMPARATIVE EXAMPLE 5

One-bath bleaching by hydrogen peroxide in alkaline state:

| | | |
|---|---|---|
| Chemicals added: | 35% $H_2O_2$ | 30 cc/l |
| | Sandozine NIT | 1 g/l |
| | Sodium silicate No. 3 | 5 g/l |
| pH: | 11.2 (pH adjusted by caustic soda) | |
| Bath ratio: | 1:10 | |
| Temperature: | 95° C. | |
| Time: | 150 minutes | |

TABLE 2

| Conditions | Yellowishness value b: Fluctuation of b | Yellowishness value b: Average b | Bleaching uneven-ness | Strength retainabi-lity |
|---|---|---|---|---|
| Unbleached raw gauze | 13.1–13.3 | 13.2 | — | 100% |
| (1) Ex. 2 | 1.0–1.2 | 1.1 | None | 98 |
| (2) Comp. Ex. 4 | 0.9–1.1 | 1.0 | None | 90 |
| (3) Comp. Ex. 5 | 1.5–5.5 | 2.9 | Yes | 95 |

Bleaching with a high whiteness and less deterioration of strength without any bleaching unevenness can be obtained according to the present invention, which is equal to the bleaching by sodium hypochlorite now employed. The present invention is also very simple in process steps.

EXAMPLE 3 AND COMPARATIVE EXAMPLES 6 AND 7

Bleaching of polyester/cotton (65/35 by weight) mix spun knit outwear requiring a soft handling was carried out under the following conditions in a wince bleaching apparatus. Results are shown in Table 3.

(1) EXAMPLE 3

Bleaching by hydrogen peroxide in a weakly acidic state:

| | | |
|---|---|---|
| Chemicals added: | 35% $H_2O_2$ | 10 cc/l |
| | Sandozine NIT | 1 g/l |
| pH: | 6.5 | |
| Bath ratio: | 1:20 | |
| Temperature: | 90° C. | |
| Time: | 60 minutes | |

Bleaching by hydrogen peroxide in a weakly alkaline state:

| | | |
|---|---|---|
| Chemicals added: | Sodium silicate No. 1 | 2 g/l |
| | NaOH | 1 g/l |
| pH: | 10.5 | |
| Temperature: | 80° C. | |
| Time: | 60 minutes | |

(2) COMPARATIVE EXAMPLE 6

Bleaching by sodium chlorite now widely employed.

Bleaching by sodium chlorite in a bleaching apparatus made from titanium

| | | |
|---|---|---|
| Chemicals added: | 25% $NaClO_2$ | 5 cc/l |
| | Sandozine NIT | 1 g/l |
| | Anti-smell agent X-50 | 0.5 g/l |
| pH | 3.5 (pH adjusted by acetic acid) | |

-continued

| | |
|---|---|
| Bath ratio: | 1:20 |
| Temperature: | 90° C. |
| Time: | 60 minutes |

↓

Water washing and dehydration

↓

Refilling into another apparatus

↓

Dechlorinating or antichlorinating additional bleaching by hydrogen peroxide in weakly alkaline state in a bleaching apparatus made from stainless steel

| | | |
|---|---|---|
| Chemicals added: | 35% $H_2O$ | 3 cc/l |
| | Sandozine NIT | 0.5 g/l |
| | Sodium silicate No. 3 | 2 g/l |
| pH | 10.5 (pH adjusted by caustic soda) | |
| Bath ratio: | 1:20 | |
| Temperature: | 80° C. | |
| Time: | 60 minutes | |

(3) COMPARATIVE EXAMPLE 7

One-bath bleaching by hydrogen peroxide in an alkaline state now widely employed:

| | | |
|---|---|---|
| Chemicals added: | 35% $H_2O_2$ | 10 cc/l |
| | Sandozine NIT | 1 g/l |
| | Sodium silicate No. 3 | 5 g/l |
| pH: | 11.5 (pH adjusted by caustic soda) | |
| Bath ratio: | 1:20 | |
| Temperature: | 90° C. | |
| Time: | 120 minutes | |

TABLE 3

| Conditions | Yellowishness value b | Handl-ing |
|---|---|---|
| Unbleached raw knit | 8.5 | 1 |
| (1) Ex. 3 | 1.8 | 4 |
| (2) Comp. Ex. 6 | 2.0 | 4 |
| (3) Comp. Ex. 7 | 2.0 | 7 |

In the case of the wince bleaching apparatus, the knit fabric is bleached under relaxation, and thus a soft handling without any bleaching unevenness can be obtained to some extent even by one-bath bleaching by hydrogen peroxide in an alkaline state, different from the natural circulation-type bleaching apparatus. According to the present invention, a much softer handling can be obtained, and bleaching equal to that by sodium chlorite can be attained.

EXAMPLE 4 AND COMPARATIVE EXAMPLES 8 AND 9

Wool/cotton (50/50 by weight) mix spun yarns were bleached under the following conditions in a jet-type skein bleaching apparatus. A high whiteness without deterioration of wool quality and mote (mainly cotton) is required for the wool/cotton mix. Results are shown in Table 4.

(1) EXAMPLE 4

Bleaching by hydrogen peroxide in a weakly acidic state:

| | | |
|---|---|---|
| Chemicals added: | 35% $H_2O_2$ | 20 cc/l |
| | Sandozine NIT | 1 g/l |
| pH: | 5.0 | |

-continued

| | |
|---|---|
| Bath ratio: | 1:30 |
| Temperature: | 90° C. |
| Time: | 60 minutes |

Bleaching by hydrogen peroxide in a weakly alkaline state:

| | | |
|---|---|---|
| Chemicals added: | Sodium pyrophosphate | 4 g/l |
| pH: | 9.0 | |
| Temperature: | 60° C. | |
| Time: | 60 minutes | |

(2) COMPARATIVE EXAMPLE 8

One-bath bleaching of cotton by hydrogen peroxide in an alkaline state:

| | | |
|---|---|---|
| Chemicals added: | 35% $H_2O_2$ | 20 cc/l |
| | Sandozine | 1 g/l |
| | Sodium silicate No. 3 | 5 g/l |
| pH: | 11.0 (pH adjusted by caustic soda) | |
| Bath ratio: | 1:30 | |
| Temperature: | 90° C. | |
| Time: | 120 minutes | |

(3) COMPARATIVE EXAMPLE 9

Ordinary bleaching of wool by hydrogen peroxide

| | | |
|---|---|---|
| Chemicals added: | 35% $H_2O_2$ | 20 cc/l |
| | Sandozine NIT | 1 g/l |
| | Sodium pyrophosphate | 3 g/l |
| pH: | 9.2 | |
| Bath ratio: | 1:30 | |
| Temperature: | 60° C. | |
| Time: | 120 minutes | |

TABLE 4

| Conditions | Yellowishness value b | Mote | Handling | Remarks |
|---|---|---|---|---|
| Unbleached yarn | 10.2 | — | 1 | |
| (1) Ex. 4 | 4.0 | None | 3 | Good handling and whiteness with no mote |
| (2) Comp. Ex. 8 | 2.8 | None | considerably hard | Good whiteness, but vigorous wool dissolution. Wool touch is lost |
| (3) Comp. Ex. 9 | 6.6 | Remarkable | 3 | Good handling, but considerable mote, and poor whiteness |

According to the present invention, effective bleaching of composite mix fabric now in fashion can be carried out.

What is claimed is:

1. A process for bleaching a fibrous material by hydrogen peroxide, which comprises bleaching a fibrous material by hydrogen peroxide in a bleaching solution having a weakly acidic state at a pH of 5–7 and at a temperature of 50°–120° C., and then adding an alkaline agent to the bleaching solution by one whole charge or continuously and successively bleaching the fibrous materials at a pH of 8.5–11 by the remaining hydrogen peroxide in a weakly alkaline state.

2. A process according to claim 1, wherein the fibrous material is natural, synthetic, or semi-synthetic fibers, or a fabric thereof.

3. A process according to claim 1, wherein the fibrous material is a composite material of cotton with wool.

4. A process according to claim 1, wherein the bleaching solution comprises hydrogen peroxide in an amount of 2–100 cc/l as 35% by weight hydrogen peroxide.

5. A process according to claim 4, wherein the bleaching solution comprises hydrogen peroxide in an amount of 5–30 cc/l as 35% by weight hydrogen peroxide.

6. A process according to claim 1, wherein the alkaline agent is at least one of alkali metal phosphates, weakly acidic salts of alkali metal, alkali metal hydroxides, ammonia water, and alkaline ammonium salts.

7. A process according to claim 1, wherein the alkaline agent is added to the bleaching solution continuously for 20 to 40 minutes.

8. A process according to claim 1, wherein the bleaching by hydrogen peroxide in the weakly acidic state and the weakly alkaline state are each carried out at a temperature of 50° to 120° C. for 0.5 to 5 hours, respectively.

9. A process according to claim 1, where water washing and dehydration are carried out after the bleaching by hydrogen peroxide in the weakly acidic state and before the bleaching by hydrogen peroxide in the weakly alkaline state.

10. A process according to claim 1, wherein hydrogen peroxide is supplemented at the time when the alkaline agent is added if the remaining hydrogen peroxide is insufficient after the bleachings by hydrogen peroxide in the weakly acidic state.

11. A process according to claim 1, wherein the bleaching is carried out in a natural circulation-type bleaching apparatus or a forced circulation type bleaching apparatus.

12. A process according to claim 1, wherein the bleaching is carried out in the presence of a surfactant as a bleaching auxiliary.

13. A process according to claim 12, wherein the surfactant is a neutral surfactant.

14. A process according to claim 12, wherein the surfactant is used in an amount of 0.1–2 g/l as a 100% pure component.

* * * * *